United States Patent [19]

Freerks

[11] 4,356,670

[45] Nov. 2, 1982

[54] APPARATUS AND METHOD FOR IN-LINE PLANING OF LUMBER USING ANGLED ABRASIVE HEAD

[75] Inventor: Conrad T. Freerks, Maplewood, Minn.

[73] Assignee: Minnesota Mining & Manufacturing Company, St. Paul, Minn.

[21] Appl. No.: 288,902

[22] Filed: Jul. 31, 1981

Related U.S. Application Data

[63] Continuation of Ser. No. 104,652, Dec. 17, 1979, abandoned.

[51] Int. Cl.[3] ..... B24B 21/04

[52] U.S. Cl. ..... 51/139; 51/135 R; 51/328; 144/123

[58] Field of Search ..... 51/135 R, 135 BT, 136, 51/137, 138, 139, 140, 74 R, 76 R, 78, 80 A, 87 R, 281 R, 328; 144/114 R, 117 A, 123, 124, 125

[56] References Cited

U.S. PATENT DOCUMENTS

| | | | |
|---|---|---|---|
| 1,158,752 | 11/1915 | Volz | 51/76 R X |
| 1,881,031 | 10/1932 | Rounsevelle | 51/135 R |
| 1,935,660 | 11/1933 | Norton | 51/138 |
| 2,162,279 | 6/1939 | Herchenrider | 51/139 |
| 2,617,223 | 11/1952 | McElroy et al. | 51/76 R |
| 2,762,173 | 9/1956 | Bottcher | 51/138 X |
| 3,092,936 | 6/1963 | Marsh | 51/138 |
| 3,468,071 | 9/1969 | Woodward | 51/137 X |
| 3,701,219 | 10/1972 | Sternal | 51/140 |
| 3,782,044 | 1/1974 | Olin | 51/138 |
| 4,322,918 | 4/1982 | Steinback | 51/138 |

FOREIGN PATENT DOCUMENTS

| | | | |
|---|---|---|---|
| 1502511 | 2/1970 | Fed. Rep. of Germany | 51/74 |

OTHER PUBLICATIONS

Forest Products Journal, Apr. 1976, "Abrasive Planing Across the Grain with Higher Grit Numbers Can Reduce Finish Sanding" Harold A. Stewart, Modern Sawmill Techniques pp. 219–226, William C. Miller.

*Primary Examiner*—Stephen G. Kunin
*Assistant Examiner*—Robert P. Olszewski
*Attorney, Agent, or Firm*—Cruzan Alexander; Donald M. Sell; John C. Barnes

[57] ABSTRACT

Method and apparatus for belt sanding of lumber to finish and dimension lumber as rough sawn lumber is moved in single file through the mill. The lumber is moved at an angle of between about 5 to 15 degrees to the axis of the contact drum of a wide belt planer. This angular relationship of the lumber beneath the belt permits the high speed planing without overstressing the abrasive belt.

5 Claims, 3 Drawing Figures

APPARATUS AND METHOD FOR IN-LINE PLANING OF LUMBER USING ANGLED ABRASIVE HEAD

This is a continuation of application Ser. No. 104,652 filed Dec. 17, 1979, now abandoned.

BACKGROUND OF THE INVENTION

This invention relates to an improvement in planing machines for use in dimensioning rough sawn lumber which is moved normally through the mill at speeds of between 400 and 750 feet per minute. The planing machine of the present invention utilizes an endless abrasive belt driven about a contact drum positioned with its axis transverse to the direction of movement of the lumber at an angle of between about 5 and 15 degrees with respect to the direction of travel of the lumber.

DESCRIPTION OF THE PRIOR ART

It is known in the prior art to dispose a contact drum of an endless belt drive system for wide abrasive belts at an angle with respect to the direction of travel of the lumber such that the sanding or the planing of the lumber is done in a direction oblique to the direction of the grain of the lumber. One such apparatus is shown in U.S. Pat. No. 3,701,219, issued Oct. 31, 1972, to L. S. Sternal. This patent discloses a sanding machine with sanding heads for fast moving abrasive belts which are disposed at an angle with respect to the direction of movement of the lumber to be sanded such that the axis of the drum contacting the workpiece is oblique to the lengthwise dimension of the workpiece and the grain of the wood. The angle of the workpiece with respect to a line perpendicular to the axis of the contact drum is not to be more than 75 degrees. In this apparatus the workpieces to be planed are moved from the single file (in-line) path to a juxtaposed batched position such that several of the boards, planks, panels or other grained surface workpieces are gathered in advance of the abrasive belt and are then moved beneath the contact roller of the abrasive belt drive assembly such that the abrasive belt is moving at an angle with respect to the grain of the lumber. Sanding the boards at this angle reduces objectional high and low areas in the wood resulting from grain relief as the boards were moved beneath the abrasive belt. After boards are sanded as taught by this patent they are again placed in line and moved on to further processing. The need for batching the lumber and then unbatching the boards requires additional equipment and material that is unnecessary with the use of the present invention.

Lumber can be fed perpendicular to the contact drum on present coated abrasive belt planers at the industry-desired line speeds of approximately 700 feet per minute, to compete with knife planers. However, this high speed is not practical from a standpoint of abrasive belt life. The practical speed for feeding a workpiece perpendicular to a single abrasive belt contact drum, for optimum abrasive life, should not exceed 200 feet per minute when removing 0.100 inch from material such as surface dried Douglas Fir. Thus the industry has adopted a process of batching the workpieces prior to feeding through the belt planer.

SUMMARY OF THE PRESENT INVENTION

The present invention provides an in-line planing machine for lumber in the mill such that sawn lumber can be dimensioned. The device of the present invention replaces the knife planers used for sizing lumber without reducing line speeds. The planing machine of this invention retains the advantages of an abrasive belt planer over a knife planer in that it reduces the downgrading of the lumber and increases yield.

This invention is directed to a method and apparatus for planing to dimension by an abrasive belt a surface of lumber as it is passed through the machine at desired line speeds. The machine of the present invention provides the desired high feed speeds, i.e. 700 feet per minute for a 4 inch board and avoids the necessity of batching rough sawn lumber prior to feeding the same through a sanding belt to smooth the surface or dimension the surface.

In the present invention the individual pieces of rough sawn lumber are moved lengthwise along a plane with the surface to be planed confined to a predetermined path. An endless abrasive belt is driven about a plurality of rollers including a contact drum, the axis of which is disposed transverse to the path of movement of the surface to be finished and is rotatable about an axis which is disposed at an acute angle with respect to the direction of movement of the workpiece of between about 5 and 15 degrees. The lumber is moved into contact with the abrasive belt adjacent one end of the contact drum and is moved across the width of the abrasive belt to exit on the other side of the contact drum adjacent its opposite end and the opposite side of the axis thereof. Depending on the amount of material to be removed, the leading corner of the workpiece contacts the belt on the drum at a point on the belt surface spaced from the perpendicular plane through the axis of the contact drum along a predetermined feed angle at a predetermined speed to obtain the desired stock removal. The invention provides an improved method of dimensioning lumber and a novel apparatus.

BRIEF DESCRIPTION OF THE ACCOMPANYING DRAWING

The present invention will be further understood with reference to the accompanying drawing wherein.

DETAILED DESCRIPTION OF THE PRESENT INVENTION

The device of the present invention affords the planing of lumber to dimension as the individual lengths are moved out of the advanced processing stations, e.g. the sawing and drying stations. This apparatus allows an in-line increase in feed rate proportional to the increase in the contact area. Thus, the apparatus of the present invention reduces the stress placed on the abrasive belt in planing lumber at the desired feed rates.

Figure 1:
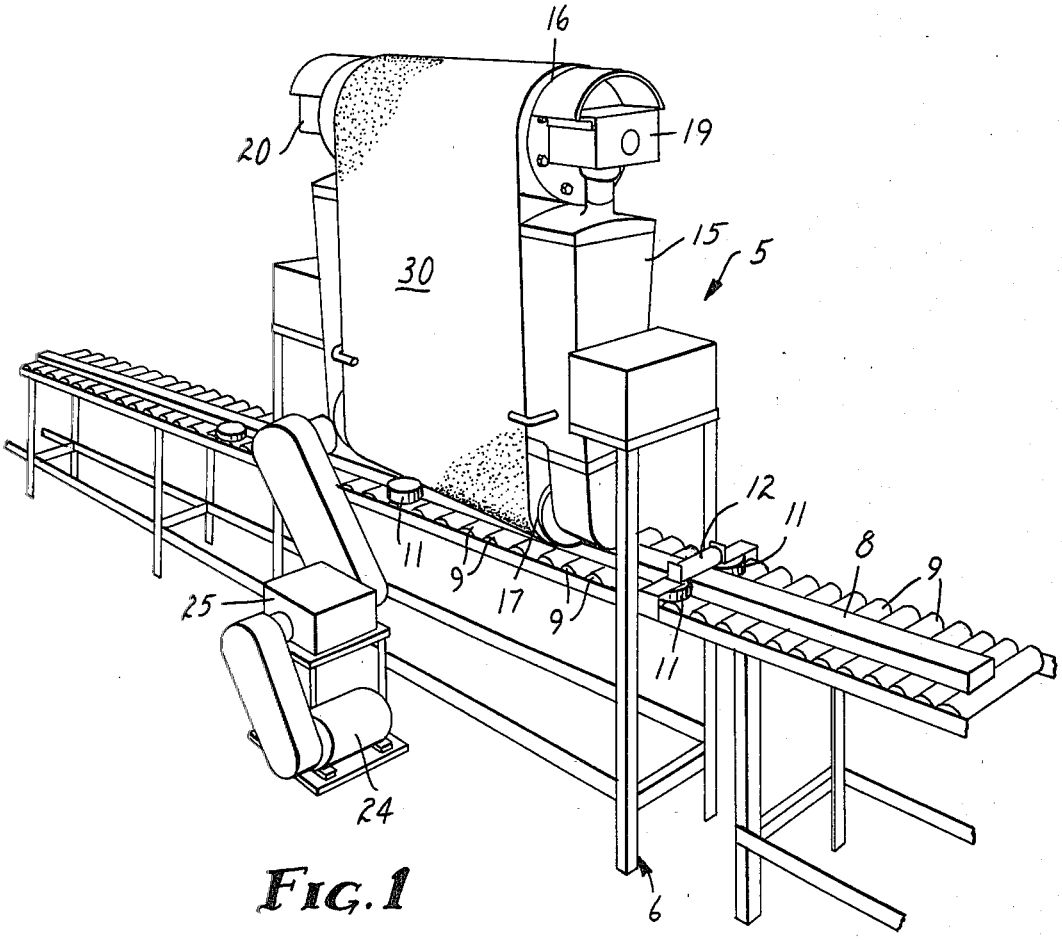
FIG. 1 is a perspective view of a planing machine constructed in accordance with the present invention showing a single wide endless abrasive belt for finishing one surface of a piece of lumber.

The apparatus of the present invention is disclosed in FIG. 1. This apparatus comprises a single planing belt device for finishing one surface of the board as it is moved through the apparatus. Additional planing belt devices or additional apparatus as illustrated can be used to finish the other three surfaces. The planer generally designated 5 is supported above a bed 6. The bed 6 is provided with a conventional lumber conveyor for advancing the lumber or workpiece 8 across the bed 6. As illustrated in FIG. 1 the conveyor comprises a plurality of driven rollers 9. Also supported on the bed and positioned thereon to constrain the lumber to a predetermined path as it is advanced by the conveyor across the bed are a plurality of driven feed and or idler rollers 11 disposed on vertical axes to feed the lumber along the conveyor and at the same time control lateral movement. A plurality of hold-down rollers 12 hold the lumber in contact with the conveyor rollers.

The planer 5 comprises a frame 15 which rotatably supports an upper idler and tensioning roll 16 and a lower driven contact roll 17. The idler roller is supported in axially spaced bearing housings 19 and 20 which housings are supported on a vertically adjustable yoke to tension the abrasive belt 30. Further, the idler roller support assembly allows pivoting movement of the idler roller about an axis perpendicular to the roller axis to steer the belt in response to the signals from the belt steering device (not shown).

A lower driven contact roll 17 is vertically adjustably and rotatably supported in the frame 15 to be set in fixed position with respect to the bed 6 and for rotation about a axis W. The contact roll 17 is driven from a suitable motor 24, through drive belts or chains and a transmission drive 25 to afford variable linear speeds for the belt 30 trained about the rollers. The abrasive belt 30 would typically have a width of 50 inches but wider belts are in use today on other machines and could be used with this process to achieve even faster feed speeds. The contact roller 17 typically may have a diameter of 8 to 16 inches. The belt may be driven at different speeds for example, as high as 12,000 surface feet per minute.

The axis of the roller 17 is disposed oblique to the upper surface of the bed 6 such that the axis is oblique to the path of the workpiece 8 as it is moved across the upper surface of the bed 6.

Figure 2:
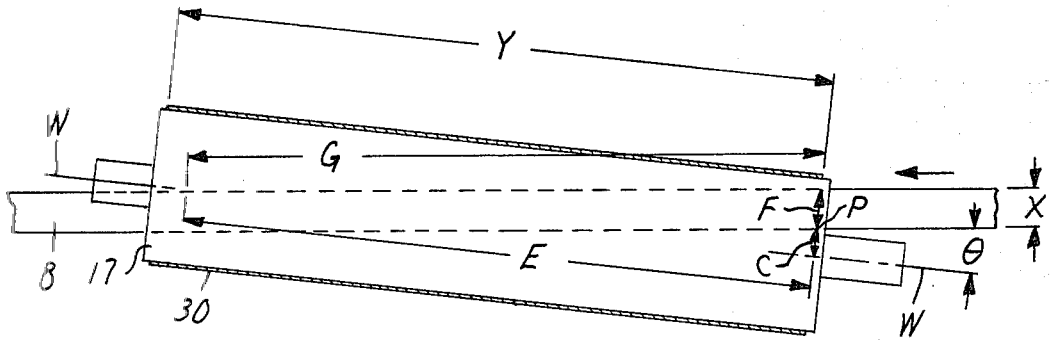
FIG. 2 is a diagrammatic plan view of the relationship of the path of movement of the lumber with respect to the axis of the contact drum.

Referring now to FIG. 2 it will be shown that the axis W of the contact roller 17 is disposed at an angle $\theta$ to the path of movement of the workpiece 8 as illustrated. The angle $\theta$ may change and thus vary the contact width E established between the workpiece and the abrasive belt. The area of contact is dependent upon the amount of material to be removed from the surface and the width X of the surface to be planed. The contact area between the surface and the belt is determined to establish the feed speed of the board in feet per minute (fpm). Also to be determined is the point P (FIG. 3) on the surface of the contact drum 17 at which the leading corner of the lumber should contact the drum to remove the maximum selected amount of material.

The contact drum 17 and the abrasive belt 30 are driven in a direction transverse to the direction of movement of the surface being planed. Thus, the dust swarf is thrown clear of the belt and reduces any sawdust build-up on the belt as is true of abrasive belts driven in a direction against the direction of movement of the lumber when it is moved into the abrasive belt at an angle of 90 degrees or approaching 90 degrees to the axis of the contact drum. Further, the angular relationship between the axis of the contact drum and the abrasive belt and the direction of the grain in the lumber will reduce the grain relief resulting on the finished lumber. This angular relationship also permits an increase in the feed rates of the lumber without increasing the stress placed on the abrasive belt to a point of premature failure.

Figure 3:
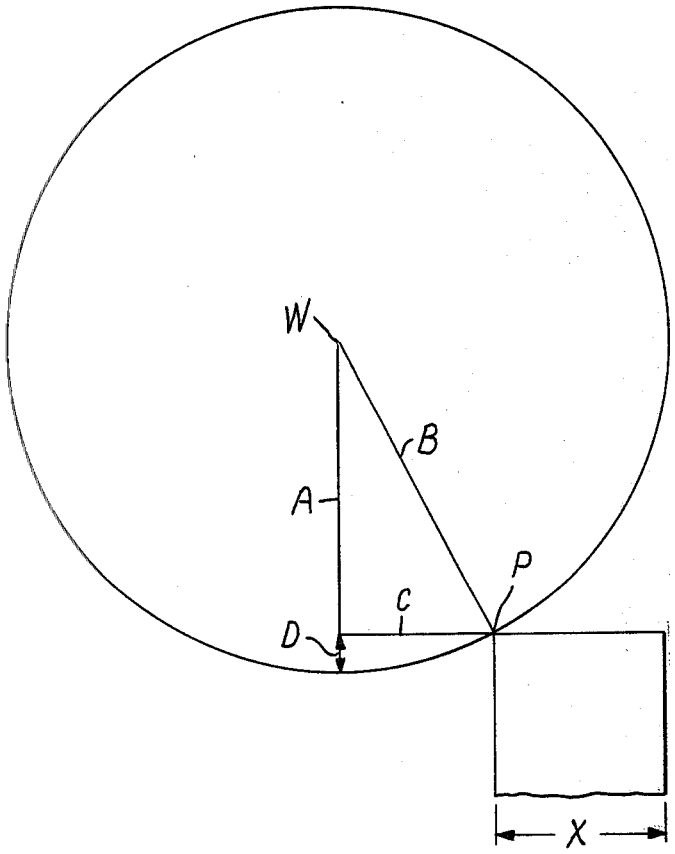
FIG. 3 is a schematic view showing the relationship between the contact drum and the lead edge of the lumber to be planed.

Referring now to FIGS. 2 and 3, the description concerning the operation of the planing head of the present invention will be hereinafter described. Presuming the abrasive belt 30 is comparable to a 24 grit alumina: zirconia or aluminum oxide mineral, resin bonded to a cloth backing such as cotton or polyester duck, and assuming the horsepower of the drive motor 24 to be 4 to 7 horsepower per inch of belt width, and a belt speed in an approximate range between 7,000 and 11,000 surface feet per minute, normal stock removal requirements at industry desired feed speeds, e.g. for 2×4 lumber 700 feet per minute, can be accomplished. Experimentation and present field practice show you can remove 2 cubic inches per second per square inch of abrasive belt is contact with a surface dried Douglas Fir board fed straight through the belt at a feed angle of 90° degrees with respect to the axis of the contact drum. Therefore, with a contact drum 12 inches in diameter it is possible to move the board through the belt at 105 feet per minute and cut the board to a depth of 0.100 inch without over-stressing the belt. As the feed angle ($\theta$) more nearly approaches 0, the feed speed of the lumber 8 may be greatly increased.

To determine the feed angle, which is an angle $\theta$ approaching parallel to the contact drum axis, the determinates are (1) the depth of cut D, (2) the workpiece width X, (3) diameter of the contact wheel and (4) the effective belt width E. Thus, for example, assume the depth of cut to be a maximum of 0.100 inch, the workpiece width being 4 inches, the diameter of the contact drum to be 12 inches, and the effective or useable belt width of a 50 inch belt to be 48 inches. The effective width is the belt width minus an allowance for tracking oscillation. From these knowns the angle $\theta$ can be determined. First, referring to FIG. 3 the distance C is determined to find where the lumber 8 will first engage the abrasive belt. This is done by finding the angle between the radius A minus D (the depth of cut) and the radius B. Thus, the cosine of the angle would equal 6 minus 0.100 divided by 6 or 0.9833 which gives an angle of 10.5 degrees. The length of C equals the tangent of the angle of 10.5 degrees times 5.9 or 1.09 inches. C equals 1.09 inches and thus the board with a width X of 4 inches would first contact the abrasive belt at a point P 1.09 inches from a vertical plane through the axis of the contact drum.

Turning now to FIG. 2, the feed angle $\theta$ can be determined by calculating the distance F, adding it to distance C and knowing E, determine the angle. To accomplish this, the angle between the axis W and a line joining the axis where the board crosses under the axis is found, spaced along the axis W a distance E. This angle is 1.30 degrees and the other leg is thus 48.012 inches so the triangle from point P across the board 8 the distance X (4 inches) and back to the cross-over point on the axis, has an angle of 4.7 degrees. By now carrying out the trigonometric calculations and determining the angles remaining, F is found to be 4.02 inches and the feed angle vector G to be 48.27 inches. $\theta$ would then be 6 degrees.

This affords the determination of the angle feed speed multiplier M which is used to set the feed speed. M is determined by dividing the feed angle vector G by the sum of C and F. In the present example the multiplier is 9.4. For the lumber chosen, Douglas Fir, at the angle of 6 degrees the angle feed speed is 105 feet per minute times M (9.4) which equals 990 feet per minute, the speed at which a 4 inch board could be moved beneath the contact drum. The multiplier M times the value for straight through feed speed produces the angle feed speed.

The through feed stock removal rate number will vary for different lumber. Thus, 2 cubic inches per second per square inch of abrasive belt in physical contact with the workpiece is a practical rate for surface dried Douglas Fir, giving a rate number of 2, accordingly the rate number for oak will be approximately 1, and Southern Pine or Ponderose Pine, surface dried, will be 3 or 4. The following table shows the through feed speeds at 90 degrees to the axis of the 12 inch diameter contact drum at various depths of cut.

| | Rate Number | | |
|---|---|---|---|
| Depth of Cut | 1 | 2 | 4 |
| .030" | 95 fpm | 195 fpm | 390 fpm |
| .050 | 75 | 155 | 310 |
| .100 | 55 | 105 | 215 |
| .200 | 35 | 75 | 155 |
| .300 | 30 | 60 | 125 |
| .500 | 20 | 45 | 90 |

Conversion factors for different diameter contact rollers for use with the above table appear below:

8"—0.82
10"—0.92
12"—1.00
14"—1.06
16"—1.17

Table A illustrates examples of the parameters with a planing head having an abrasive belt with the effective useable width E of 48 inches, the contact roller 17 having a diameter of 12 inches and a stock removal rate number of 2. Speeds of as high as 2600 feet per minute can be obtained with a shallow cut on a 4 inch board width and thus in-line dimensioning is clearly afforded.

Similar tables can be worked out for other belt or board widths, contact drum diameters, etc.

Lumber of between 0.5 inch and 12 inches can be effectively processed by this method. Dimensioned lumber however has reduced dimensions, e.g. a 2 by 4 has finished dimensions less than 2 inches thick and 4 inches wide. The 4 inch width used herein is used to represent the 4 inch side of the board.

TABLE A

| Depth Of Cut D | "C" | Board Width X | Thru Feed Vector C + F | Multi-Plier M | ⊥ Feed Speed fpm | Feed Angle Θ | Angle Feed Speed fpm |
|---|---|---|---|---|---|---|---|
| .020" | .48 | 4" | 4.48" | 10.7 | 244 | 5.4° | 2610 |
| | | 6 | 6.48 | 7.4 | | 7.7 | 1805 |
| | | 8 | 8.58 | 5.6 | | 10.1 | 1366 |
| | | 10 | 10.68 | 4.6 | | 12.6 | 1122 |
| | | 12 | 12.88 | 3.8 | | 15.0 | 927 |
| .050" | .77" | 4" | 4.75" | 10.1 | 155 | 5.6° | 1560 |
| | | 6 | 6.7 | 7.2 | | 8.0 | 1115 |
| | | 8 | 8.6 | 5.6 | | 10.5 | 870 |
| | | 10 | 10.5 | 4.6 | | 12.9 | 710 |
| | | 12 | 12.3 | 4.0 | | 15.3 | 620 |
| .100" | 1.09" | 4" | 5.1" | 9.4 | 105 | 6.0° | 990 |
| | | 6 | 7.1 | 6.8 | | 8.3 | 715 |
| | | 8 | 9.2 | 5.3 | | 10.8 | 555 |
| | | 10 | 11.4 | 4.3 | | 13.4 | 450 |
| | | 12 | 13.6 | 3.7 | | 15.7 | 380 |
| .150" | 1.33" | 4" | 5.35" | 9.0 | 89.3 | 6.2° | 803 |
| | | 6 | 7.4 | 6.5 | | 8.7 | 580 |
| | | 8 | 9.48 | 5.1 | | 11.1 | 455 |
| | | 10 | 11.6 | 4.2 | | 13.6 | 375 |

TABLE A-continued

| Depth Of Cut D | "C" | Board Width X | Thru Feed Vector C + F | Multi-Plier M | ⊥ Feed Speed fpm | Feed Angle Θ | Angle Feed Speed fpm |
|---|---|---|---|---|---|---|---|
| | | 12 | 13.7 | 3.6 | | 16.0 | 321 |
| .200" | 1.55" | 4" | 5.55" | 8.6" | 80 | 6.6° | 688 |
| | | 6 | 7.55 | 6.4 | | 9.0 | 512 |
| | | 8 | 9.65 | 5.1 | | 11.4 | 408 |
| | | 10 | 11.85 | 4.1 | | 13.8 | 328 |
| | | 12 | 14.05 | 3.5 | | 16.3 | 280 |

The feed angle is subject to change along with feed speed when the effective width of the belt changes. However, from the following table it will be learned that the industry desired feed speed is obtained for 4 inch wide lumber, a 12 inch diameter roller, a rate number of 2 and a depth of cut of 0.100 inch, on surface dried Douglas Fir with a straight through feed speed of 105 fpm, when a belt at least 34 inches wide is used and the angle is 8.5°.

TABLE B

| Useable Belt Width In Inches | Feed Angle | Multiplier | Approximate Feed Speed fpm |
|---|---|---|---|
| 14 | 20.9° | 2.8 | 295 |
| 16 | 18.3° | 3.1 | 333 |
| 18 | 16.2° | 3.5 | 377 |
| 20 | 14.6° | 3.9 | 415 |
| 22 | 13.2 | 4.4 | 463 |
| 24 | 12.1° | 4.8 | 504 |
| 26 | 11.2° | 5.1 | 545 |
| 28 | 10.4° | 5.5 | 584 |
| 30 | 9.6° | 5.9 | 623 |
| 32 | 9.1° | 6.3 | 665 |
| 34 | 8.5° | 6.7 | 712 |
| 36 | 8.0° | 7.1 | 745 |
| 38 | 7.6° | 7.5 | 788 |
| 40 | 7.2° | 7.9 | 829 |
| 42 | 6.9° | 8.2 | 868 |
| 44 | 6.6° | 8.6 | 910 |
| 46 | 6.3° | 9.0 | 951 |
| 48 | 6.0° | 9.4 | 992 |

These tables show that a feed angle of more than 15 degrees does not provide the desired line speed and this speed is consistently attained with the normal 50 inch belt with a wide range of stock removal.

The tables also show the working range of the planer of this invention to have a feed angle of between about 5 (5.4) degrees and about 15 (16.3 maximum with a wide board and/or unusual depth of cut) degrees. At these angles the feed speed of the lumber exceeds, by a substantial factor, the feed speed perpendicular (⊥) to the axis of the contact drum which is practiced presently. On the widest board the feed speed is increased by a device of this invention by a factor greater than three and there is no necessity of building batching and unbatching equipment. The result should be a substantial cost reduction.

Having thus described the present invention with reference to a machine head, which is generally constructed according to pre-existing wide belt sanders, and disposing it to perform the novel process, it is to be understood that details may be changed without departing from the invention as claimed.

I claim:

1. An in-line angle planing apparatus for planing a surface of a workpiece comprising a length of lumber, said apparatus comprising a bed, conveyor means supported by said bed for carrying a workpiece longitudinally along a linear path across said bed, support and drive means for an endless abrasive belt comprising a plurality of rolls, one of which is a contact drum having an axis disposed at an angle of between 5 and 15 degrees to said path and having sufficient length to extend across the width of said path at a said angle and support a said belt having a width sufficient to extend across said path, and drive means for driving one of said rolls, means constraining a said workpiece for movement by said conveyor means longitudinally of said bed and past said contact drum such that said workpiece engages said belt on said contact drum adjacent one end on one side of the axis of said drum and exits adjacent the other end of said drum on the opposite side of said axis and wherein said workpiece contacts and moves across said belt at an angle of between 5 and 15 degrees to the axis of said drum.

2. An apparatus according to claim 1 wherein said conveyor means can carry said workpiece through said means constraining said workpiece at a feed speed exceeding 415 feet per minute.

3. Method of planing a surface of a workpiece comprising a piece of lumber for the purpose of dimensioning the workpiece, said method comprising the steps of advancing the workpiece longitudinally along a predetermined path, disposing a contact drum with its axis transverse to and across the width of the said path, driving an endless abrasive belt over a plurality of rolls, one of which is said contact drum, said belt having a width to extend across the width of the said path, and disposing said contact drum with respect to the direction of said path such that the axis of the contact drum is disposed at an angle between 5 to 15 degrees with respect to the path of the workpiece such that said workpiece contacts the surface of the belt on said drum adjacent one end spaced to one side of the axis thereof and passes beneath the drum and exits adjacent the opposite end of the drum on the side of the axis opposite the side at which it entered, thus the workpiece contacts with the effective width of the abrasive belt as it moves beneath the drum.

4. The method of claim 3 wherein said workpiece has a normal board dimension between 0.5 inch and 12 inches, and the feed rate is at least 3 times faster than at a feed angle perpendicular to the contact drum.

5. The method of claim 3 wherein the abrasive belt has a width of at least 14 inches and the belt is driven at a speed of between 5000 and 12,000 surface feet per minute.

* * * * *